United States Patent [19]

Gybowski

[11] 3,940,141

[45] Feb. 24, 1976

[54] GAME DEVICE

[76] Inventor: Frank Gybowski, 34 Edgewood Way, New Haven, Conn. 06515

[22] Filed: Sept. 26, 1974

[21] Appl. No.: 509,447

Related U.S. Application Data

[62] Division of Ser. No. 343,356, March 21, 1973, abandoned.

[52] U.S. Cl. ..... 273/143 R; 46/2

[51] Int. Cl.[2] ..... A63F 5/04

[58] Field of Search ..... 273/143 R, 143 A, 143 B, 273/143 C, 143 D, 143 E, 142 R, 142 A, 142 B, 142 C, 142 D, 142 E, 142 F, 142 G, 142 H, 142 HA, 142 J, 142 JA, 142 JB, 142 JC, 142 JD, 142 K, 147, 127 R, 127 D, 138 R, 1 R; 35/77; 40/77.8, 77.9, 77.4, 77.6, 77.7; 46/49, 47, 2, 3, 4

[56] References Cited

UNITED STATES PATENTS

| | | | |
|---|---|---|---|
| 634,579 | 10/1899 | Long et al. | 273/143 A |
| 1,571,503 | 2/1926 | Barber | 273/127 R |
| 1,600,609 | 9/1926 | Wendler et al. | 273/138 R |
| 2,056,515 | 10/1936 | Glaser | 273/143 R |
| 2,754,124 | 7/1956 | Finney | 273/143 R |
| 3,256,022 | 6/1966 | Dreiblatt | 273/143 R |
| 3,463,487 | 8/1969 | Tepper | 273/143 R X |
| 3,784,197 | 1/1974 | Massicotte | 273/143 R X |

FOREIGN PATENTS OR APPLICATIONS

| | | | |
|---|---|---|---|
| 488,711 | 1/1954 | Italy | 273/143 R |

*Primary Examiner*—Richard J. Apley
*Assistant Examiner*—Arnold W. Kramer
*Attorney, Agent, or Firm*—DeLio and Montgomery

[57] ABSTRACT

A game device having a housing, comprising: two spaced apart upstanding support members; a first bar mounted horizontally within the housing between the support members; at least one open-ended, hollow cylinder loosely supported on the first bar, the cylinder having game indicia on its exterior surface; and an arm for momentarily imposing a force against the exterior wall of the cylinder, whereby the cylinder is caused to swing freely and eccentrically on and around the bar, and game points or results are determined by the positions of the indicia relative to a fixed point of reference when the cylinder is indexed by a projection member on a player actuated indexing member entering one of several apertures disposed circumferentially around the cylinder.

8 Claims, 5 Drawing Figures

GAME DEVICE

This is a division of application Ser. No. 343,356, filed Mar. 21, 1973, and now abandoned.

BACKGROUND OF THE INVENTION

This invention relates to a game device of the freely rotating cylinder type, wherein game points or results are determined by positions of indicia on the cylinder relative to a fixed point of reference when the cylinder comes to rest.

Representative of game devices of the invention are the so-called "slot machines". In such machines one or more cylinders are caused to rotate by a force applied in various ways. Such forces can be purely mechanical, electrical, magnetic, or combinations of such. The force for rotating the cylinders is usually activated, or permitted to be activated, by the insertion of a coin or token into the device. The cylinders then rotate freely, and either are permitted to come to rest in their own time, or can be braked to a rest by suitable means, such as a mechanical brake operated by a crank-type handle. Sometimes, the insertion of the coin or token merely makes operation of the machine possible, and the force for rotating the cylinders as well as the brake is combined in a single mechanism operated, for example, by the well known crank-type arm.

Such game devices tend to be complex and expensive, and depend upon precision bearings and the like for free rotation of the cylinders.

OBJECTS AND SUMMARY

Accordingly, an object of the invention is to provide a new and improved game device based upon a new principle of operation.

Another object is to provide a new and improved game device for games of chance, which incorporates non-complex and inexpensive mechanical operating elements, and which is simple to operate.

These and other objects, features and advantages of the invention will be apparent from the specification which follows.

In summary outline, the invention is a game device having a housing, comprising: a pair of spaced apart, upstanding support members; a first bar mounted horizontally between the support members; at least one open-ended, hollow cylinder supported on the bar with the inner surface of the cylinder in contact with the bar; and means for momentarily imposing a force against the exterior surface of the cylinder, whereby the cylinder is caused to swing freely on and around the bar.

The invention accordingly comprises a device possessing the features, properties, and the relation of elements which will be exemplified in the article hereinafter described, and the scope of the invention will be indicated in the claims.

DETAILED DESCRIPTION

For a fuller understanding of the nature and objects of the invention, reference is made to the following description taken in conjunction with the accompanying drawings, in which.

Figure 1:
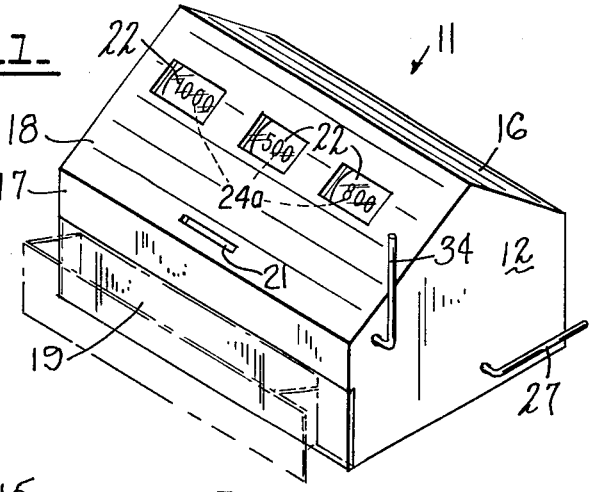
FIG. 1 is a partially diagrammatic, perspective view of a device of the invention on a miniaturized scale.
Figure 2:
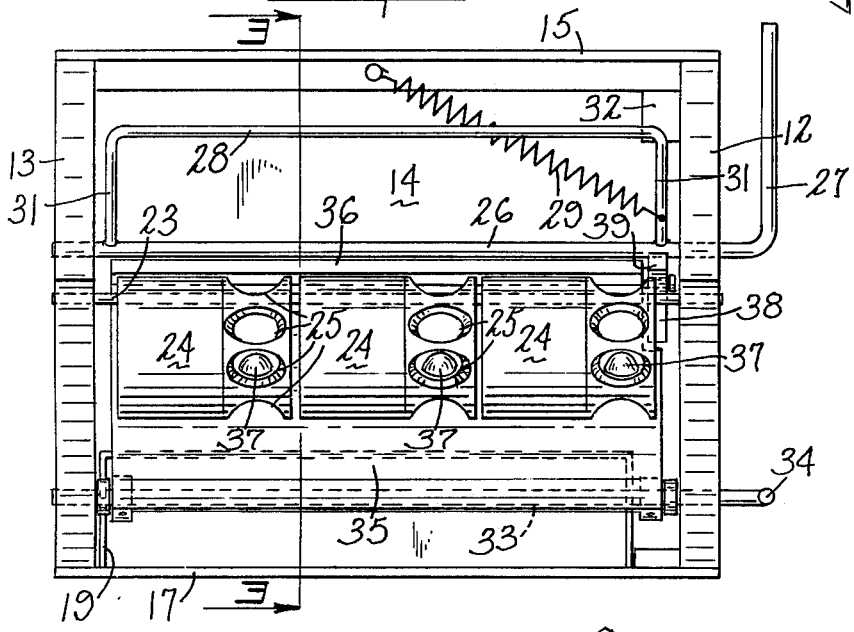
FIG. 2 is a somewhat enlarged, partially diagrammatic, plan view of the device of FIG. 1 with the top removed to show underlying structure.

With reference to FIGS. 1–4, one embodiment 11 of the game device of the invention is illustrated. The device has a housing which includes a pair of spaced apart, upstanding support members such as parallel side walls 12 and 13. The housing further includes a base member or floor 14, a back wall having a lower portion 15 and a sloping upper portion 16, and a front wall having a similar lower portion 17 and a sloping upper portion 18. The sloping wall portions 16 and 18 together form a top or roof of the housing.

A drawer 19 is slidably received in the front wall portion 17 for collection of coins or tokens inserted through a slot 21 in upper front wall portion 18. By suitable mechanisms (not shown), a coin or token inserted in slot 21 will activate, or permit activation of, the game device.

One or more windows 22 in the upper roof wall portion 18 permit viewing of game indicia on rotatable cylinders to be described. A first bar 23 is fixedly mounted horizontally within the housing between the end walls 12 and 13. Riding on bar 23 are three rotatable, open-ended cylinders 24 having game indicia 24a on the exterior walls thereof. The inner surfaces or walls of the cylinders 24 are in sliding or rolling contact with bar 23, and the diameter, wall thickness and weight of the cylinders are such as to permit them to swing freely and eccentrically on and around the bar 23. Each of the cylinders 24 has a plurality of encircling apertures 25 having a purpose to be explained below. The cylinders may be polygonal rather than round, if desired.

A second bar 26 is rotatably mounted in the housing between end walls 12 and 13, parallel to the first bar 23. The spacing between bars 23 and 26 should be slightly more than the diameter of cylinders 24 so that the cylinders can swing freely on and around bar 23 without touching bar 26. One end of bar 26 extends through the wall 12 and has a crank-type handle 27 to facilitate rotation thereof. The handle 27 may be substituted by a knob or similar actuating device, if desired. Connected transversely of bar 26 is an arm or similar member such as the U-shaped member illustrated, having a cross bar member 28 positioned for striking an exterior wall of the cylinders 24 when the bar 26 is rotated as by moving handle 27. The angle of contact of member 28 with cylinders 24 is somewhat tangential since member 28 "sweeps" against and past the cylinders. The striking force of member 28 is maximized by an spring 29 under tension joining one of the pair of connector arms 31 to a portion of the housing such as rear wall 15.

Figure 3:
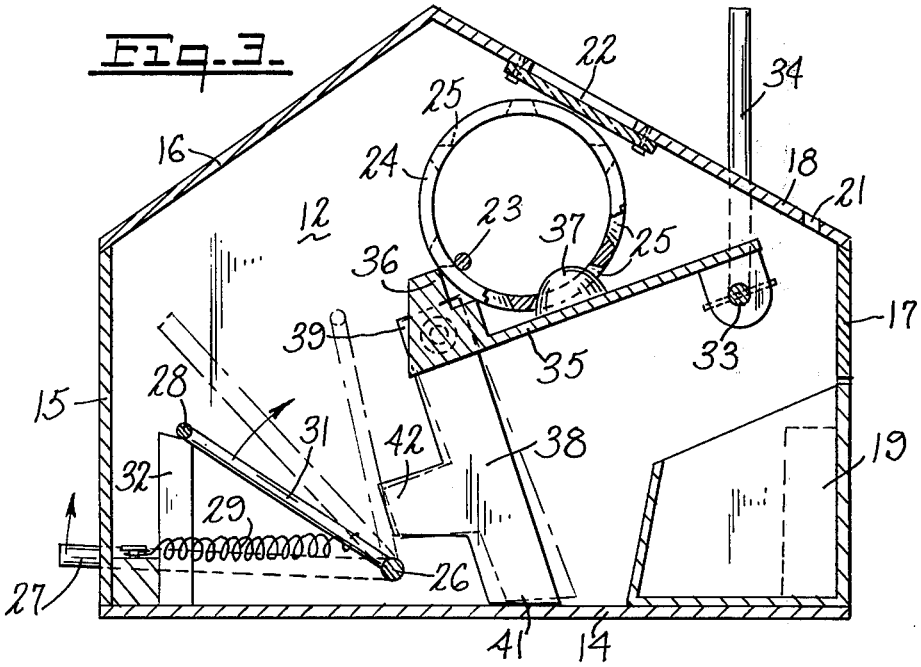
FIG. 3 is a vertical section along the line 3—3 of FIG. 2 but with the top shown in FIG. 1 replaced.
Figure 4:
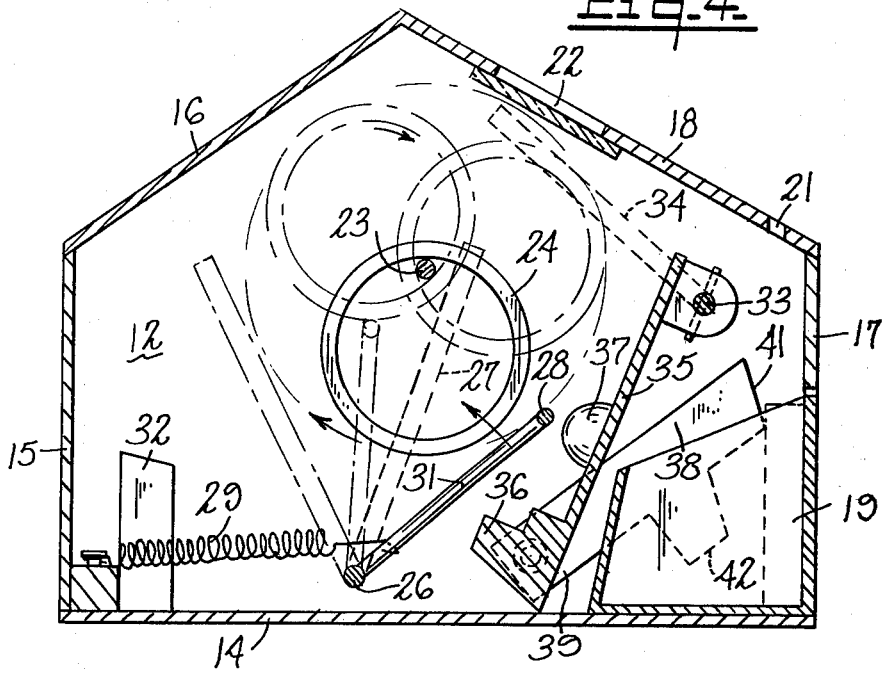
FIG. 4 is also a vertical section along the line 3—3 of FIG. 2, as in FIG. 3, showing the relative positions of elements of structure during operation of the device.

As most clearly appears in FIGS. 3 and 4, the cross member 28 is first cocked by moving the crank-type handle 27 upwardly in the view of FIG. 3 such that the cross member 28 moves under the cylinder 24 to a position just to the right of the cylinder, as shown in the solid lines in FIG. 4. The handle 27 is then urged quickly downwardly as shown in outline in FIG. 4, preferably under tension from spring 29. As a result, the cross member 28 strikes the outer wall of cylinder 24, and the cylinder 24 is impelled from right to left in FIG. 4 so as to swing freely on and around the bar 23 shown in outline in FIG. 4. The cylinder 24 finally comes to rest on bar 2 when its energy is spent. Cross member 28 of course is restored to rest on a post 32.

The cylinder 24 can be braked as it freely swings on and around bar 23 in the following manner by the structure to be described. A third bar 33 is rotatably mounted between end walls 12 and 13 parallel to bars 23 and 26. A crank-type handle 34, or similar activating means, may form an extension of bar 33. Affixed transversely of bar 33 near an edge thereof is a generally rectangular panel member 35 which will sweep out an arc when bar 33 is rotated. An upstanding edge or similar abutment member 36 is positioned along the other edge of the panel member 35 parallel with bar 33. The abutment member 36, when cylinder 24 is in a rest position, cradles the cylinder 24 in such position that indicia 24*a* on the exterior wall of the cylinder 24, are viewable through window 22. Mounted on panel member 35 is one or more stop members such as projections 37. The number of such projections 37 corresponds to the number of cylinders 24. The projections 37 are illustrated as hemispherical members shaped to be received in the apertures 25. However, the stop members or projections may have any other shape or form effective for the functions described below.

A dog member 38 has one end 39 pivotally connected to an edge of abutment member 36. The dog member 38 has a first foot 41 for engagement with the floor 14 of the housing, and a second foot 42 intermediate the ends of the dog member.

As more clearly appears in FIGS. 3 and 4, the panel member 35 and dog member 38 cooperate to brake the free swinging of cylinder 24 as follows. The rest positions of the members are shown in solid line in FIG. 3 and cocked positions are shown in solid line in FIG. 4. Intermediate positions are illustrated in broken line in FIGS. 3 and 4. With reference to FIG. 3, when the cylinder 24 has been struck by cross member 28 so as to cause it to swing around bar 23, the handle 34 of the braking means is pulled clockwise. As a result, the panel member 35 is also urged clockwise and upwardly such that the projection 37 locates and enters an aperture 25 in a cylinder 24. Such entry thereby stops the motion of the cylinder 24. At the same time, the abutment member 36 cradles the cylinder 24 and thus holds it in position on the projection 37. Simultaneously, the dog member 38 swings clockwise under abutment member 36 such that its first foot 41 rests on floor 14, thereby maintaining abutment member 36 and projection 37 in their cylinder-supporting positions. When it is next desired to cause the cylinder 24 to swing on and around bar 23, as most clearly appears from FIG. 3, the handle 27 is raised in the direction indicated by the arrow and second foot 42 of dog member 38 is thereby contacted by the upright member 31, thus causing the dog member 38 to pivot counterclockwise and releasing the cylinder 24 from its cradling position on abutment member 36 and projection 37. Cross member 28 is thus moved to its cocked position (FIG. 4) in preparation for again striking cylinders 24.

By virtue of these operations, it will be seen that the cylinder 24 can be simply and quickly caused to swing on and around bar 23, and such movement can be arrested at any moment by activation of the braking means, as by clockwise displacement of handle 34. The ability to arrest the movement of the cylinders 24 promotes the amusement and unpredictability of the game, by virtue of an attempt by the player to stop the movement of the cylinders when he believes his game score will be enhanced.

Figure 5:
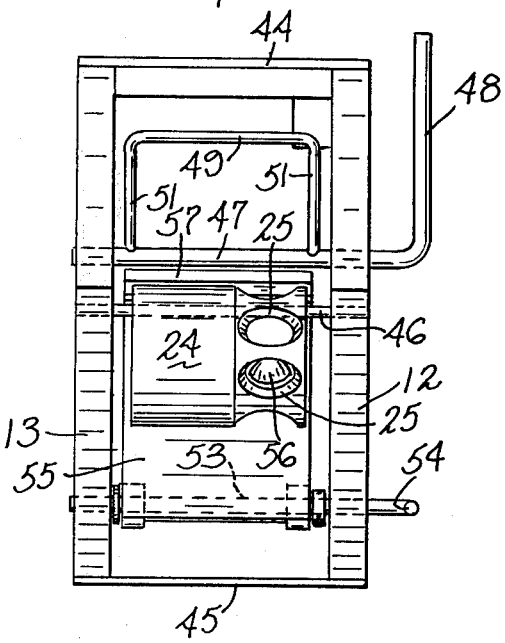
FIG. 5 is a top plan view of another embodiment of device of the invention in more simplified form.

In another embodiment of game device of the invention, illustrated in FIG. 5, the structure may be further simplified. With reference thereto, the housing may include a rear wall portion 44, a front wall portion 45, and side walls 12 and 13 which fixedly support a bar 46 therebetween, similar to bar 23 of the embodiment of FIGS. 1–4. However, only a single cylinder 24 is positioned for swinging on and around the bar 46, the cylinder 24 in all essential respects being identical to the cylinders 24 of the prior embodiment. A rotatable second bar 47 having a crank-type handle 48 is used to cause a cross member 49 to strike the wall of cylinder 34 so as to cause the cylinder to swing, in essentially the same manner as in the prior embodiment. The cross member 49 is connected to rotatable bar 47 by connector arms 51. An spring is not shown because such is not necessarily required for operation of the rotatable bar 47 and its cross member 49. After cocking of the cross member 49 by moving handle 48 downwardly in FIG. 5, the handle 48 may be quickly returned to the position shown in FIG. 5, with the effect of forcefully striking the cylinder 24 in its return movement. Braking means similar to that of the embodiment of FIGS. 1–4 may be provided, if desired. As shown in FIG. 5, such braking means may include a third rotatable bar 53 having a crank-type handle 54, or similar activating member, together with a generally rectangular panel member 55 affixed longitudinally of bar 53. Projections 56 and an abutting edge 57 are part of the panel member structure, as in the embodiment of FIGS. 1–4. Except for differences in dimensions, the braking means comprising the foregoing structure operates in essentially the same manner as does the braking means illustrated in FIGS. 1–4.

The material of construction of the game device is not important to its inventive character, since the device and its components are readily manufactured of wood, metal, plastic, or combinations of such.

In view of the foregoing description it will be apparent that the invention is not limited to the specific details set forth therein for the purposes of illustration, and that various other modifications are equivalent for the stated and illustrated functions without departing from the spirit and scope of the invention.

What is claimed is:

1. A game device having a stationary housing, comprising:

a pair of spaced apart, upstanding support members at opposite ends of the housing;

a first bar mounted horizontally on and between said support members;

at least one open-ended, hollow cylinder supported on said first bar with the inner surface of said cylinder in contact with said first bar, said cylinder having an inside diameter substantially greater than the diameter of said first bar and said cylinder having circumferentially disposed indicia on its outer surface;

player actuated mechanical means for striking the exterior surface of said cylinder, whereby said cylinder is caused to swing freely and eccentrically on and around said first bar;

mechanical means for braking said cylinder while said cylinder is swinging freely on and around said first bar to arrest the movement of said cylinder and place said indicia in a significant position relative to the housing; and manually actuated means for moving said braking means into engagement with said cylinder.

2. A game device as in claim 1 wherein the housing includes a wall enclosing the front of said device, said wall having at least one window for viewing said indicia, and the said significant position of said indicia being the position where it can be viewed in said window.

3. A game device as in claim 1 wherein the wall of said cylinder has a plurality of circumferentially disposed apertures in the surface thereof, and wherein said braking means comprises a rotatable bar mounted in said housing and projecting members transversely connected to said rotatable bar, said projecting members corresponding in number to said cylinders and each being arranged to enter one of said apertures of a respective cylinder when said rotatable bar is rotated to thereby prevent further swinging of said cylinder on said first bar, the locations of said apertures and projecting members being such that at least one of the indicia on each cylinder is accurately indexed in a significant position when one of said members is engaged in one of said apertures.

4. A game device as in claim 3 wherein said projecting members are mounted on a generally rectangular panel member so as to project at generally right angles therefrom.

5. A game device as in claim 4 wherein said panel member has an abutment member angularly positioned along one edge of said panel member, said abutment member and said panel member being arranged to cradle said cylinders as said projecting members enter the apertures of the cylinders.

6. A game device as in claim 5 further including a dog member pivotally connected to said panel member, said dog member being adapted to hold said panel in position when said projecting members enter said apertures, and to be restored to a non-holding position in response to contact with the striking means for causing said cylinder to swing freely on and around the first bar of said device.

7. A game device as in claim 1, including a wall enclosing the front of said device, said wall having at least one window therethrough for viewing of said indicia, said wall also having a slot for insertion of coins or tokens, said device further including a drawer-like member mounted in said housing and positioned to collect said coins or tokens.

8. A game device as in claim 1 wherein the striking means includes a member pivotally mounted in said housing in a position to swing into contact with said at least one cylinder, and means external of the housing for actuating said striking means.

* * * * *